US008708875B2

(12) United States Patent
Prohaska et al.

(10) Patent No.: US 8,708,875 B2
(45) Date of Patent: Apr. 29, 2014

(54) COLLAPSIBLE BABY BOUNCER

(76) Inventors: April Prohaska, Dallas, TX (US); Meggan Yedsena, Dallas, TX (US)

( * ) Notice: Subject to any disclaimer, the term of this patent is extended or adjusted under 35 U.S.C. 154(b) by 76 days.

(21) Appl. No.: 12/911,375

(22) Filed: Oct. 25, 2010

(65) Prior Publication Data

US 2012/0100972 A1 Apr. 26, 2012

(51) Int. Cl.

| | |
|---|---|
| ***A63B 26/00*** | (2006.01) |
| ***A63B 25/08*** | (2006.01) |
| ***A47D 13/10*** | (2006.01) |
| ***A63G 9/00*** | (2006.01) |

(52) U.S. Cl.
USPC ..... 482/142; 482/77; 297/274

(58) Field of Classification Search
USPC ..... 482/66–69, 77; 472/14–15, 103–105, 472/135, 118; 297/273–275
See application file for complete search history.

(56) References Cited

U.S. PATENT DOCUMENTS

| | | | | |
|---|---|---|---|---|
| 2,715,935 | A * | 8/1955 | Berry, Jr. | 297/285 |
| 3,656,728 | A | 4/1972 | Griggs | |
| 3,909,061 | A | 9/1975 | Johnson | |
| 4,230,364 | A * | 10/1980 | Parker | 297/468 |
| 5,360,258 | A | 11/1994 | Alivizatos | |
| 5,690,383 | A * | 11/1997 | Meeker | 297/274 |
| 5,700,201 | A | 12/1997 | Bellows et al. | |
| 5,816,983 | A * | 10/1998 | Dawes et al. | 482/78 |
| 5,857,944 | A * | 1/1999 | Cone et al. | 482/66 |
| 6,019,427 | A * | 2/2000 | Combest | 297/277 |
| 6,030,039 | A * | 2/2000 | Essler | 297/273 |
| 6,126,234 | A | 10/2000 | Cabagnero | |
| 7,189,164 | B1 * | 3/2007 | Paesang et al. | 472/118 |
| 7,234,722 | B1 | 6/2007 | Madigan et al. | |
| 7,546,652 | B1 | 6/2009 | Maloof et al. | |
| 7,614,979 | B2 * | 11/2009 | Thomson et al. | 482/69 |
| 7,727,076 | B2 * | 6/2010 | Bapst et al. | 472/103 |
| 2007/0040431 | A1 * | 2/2007 | Bapst et al. | 297/274 |
| 2008/0012409 | A1 * | 1/2008 | Chen et al. | 297/274 |

* cited by examiner

*Primary Examiner* — Oren Ginsberg
*Assistant Examiner* — Gregory Winter

(57) ABSTRACT

A collapsible baby bouncer for portable travel comprising a seat having two leg holes in a seat pocket, at least three support legs that form a tripod, at least three springs that extend from the top end of a support leg to the seat, and structural arms for retaining the support legs in an operational configuration. The baby bouncer further includes at least one structural arm that can be collapsed to allow the baby bouncer to be formed into an elongated shape that can fit into a carry sleeve.

9 Claims, 4 Drawing Sheets

COLLAPSIBLE BABY BOUNCER

FIELD OF THE INVENTION

The presently disclosed subject matter is directed towards a portable baby bouncer, and more particularly towards an easily transportable, light weight, and collapsible baby bouncer.

BACKGROUND OF THE INVENTION

Baby bouncers are a class of popular products for parents and their infants. Basically a baby bouncer is a device that holds an infant and provides them with gentle motion in a manner that can stimulate an infant when they are active, soothe them when they are not, enable an infant to exercise, all while enhancing free time for parents. Baby bouncers are typically used by infants between the ages of 4 months and 1 year, that weigh less than about 26 pounds, that are less than about 32 inches tall, and that can sit up by themselves.

In general, a baby bouncer has a seat that cradles an infant and that is retained in a flexible manner on a stand. The seat and stand are beneficially dimensioned so that when the baby bouncer is located on a surface that an infant can jump, kick, and partially stand in a manner that allows the infant to exercise, entertain itself, and to burn off excess energy to enable the infant to sleep. When the infant moves the flexible seat gently bounces the infant in accord with the infant's movement. A baby bouncer may include any number of additional features such as rattles, bells, toy bars, and visual stimulators such as lights and mirrors to soothe and/or stimulate the baby.

While baby bouncers have been highly successful, that success has itself created a problem. Baby bouncers are so popular and useful that both parents and babies want them readily available, even when traveling. However, prior art baby bouncers are typically not very portable. Thus, when parents and babies travel this has made it relatively difficult to bring a baby bouncer along, particularly with all of the other products a parent usually carries, such as diapers, baby wipes, powders, changes of cloths, etc. While there are some prior art baby bouncers that are relatively transportable, they are particularly not easy to use, small in size and/or lightweight.

Because of their popularity and because of the desirability to bring them along when traveling, a lightweight baby bouncer that folds into a compact space is highly desirable.

BRIEF SUMMARY OF THE INVENTION

The principles of the present invention provide for a lightweight baby bouncer that folds into a compact space. The baby bouncer includes a seat having two leg holes in a seat pocket, at least three support legs that form a tripod, the top end of each support leg extends through a spring to the seat, and structural arms for rigidly retaining the baby bouncer in an operating configuration. The baby bouncer includes at least one structural arm can be collapsed to allow said baby bounder to be formed into an elongated shape that can fit into a carry sleeve.

BRIEF DESCRIPTION OF THE DRAWINGS

The advantages and features of the present invention will become better understood with reference to the following detailed description and claims taken in conjunction with the accompanying drawings, in which like elements are identified with like symbols, and in which:

DETAILED DESCRIPTION OF THE INVENTION

Figure 1:
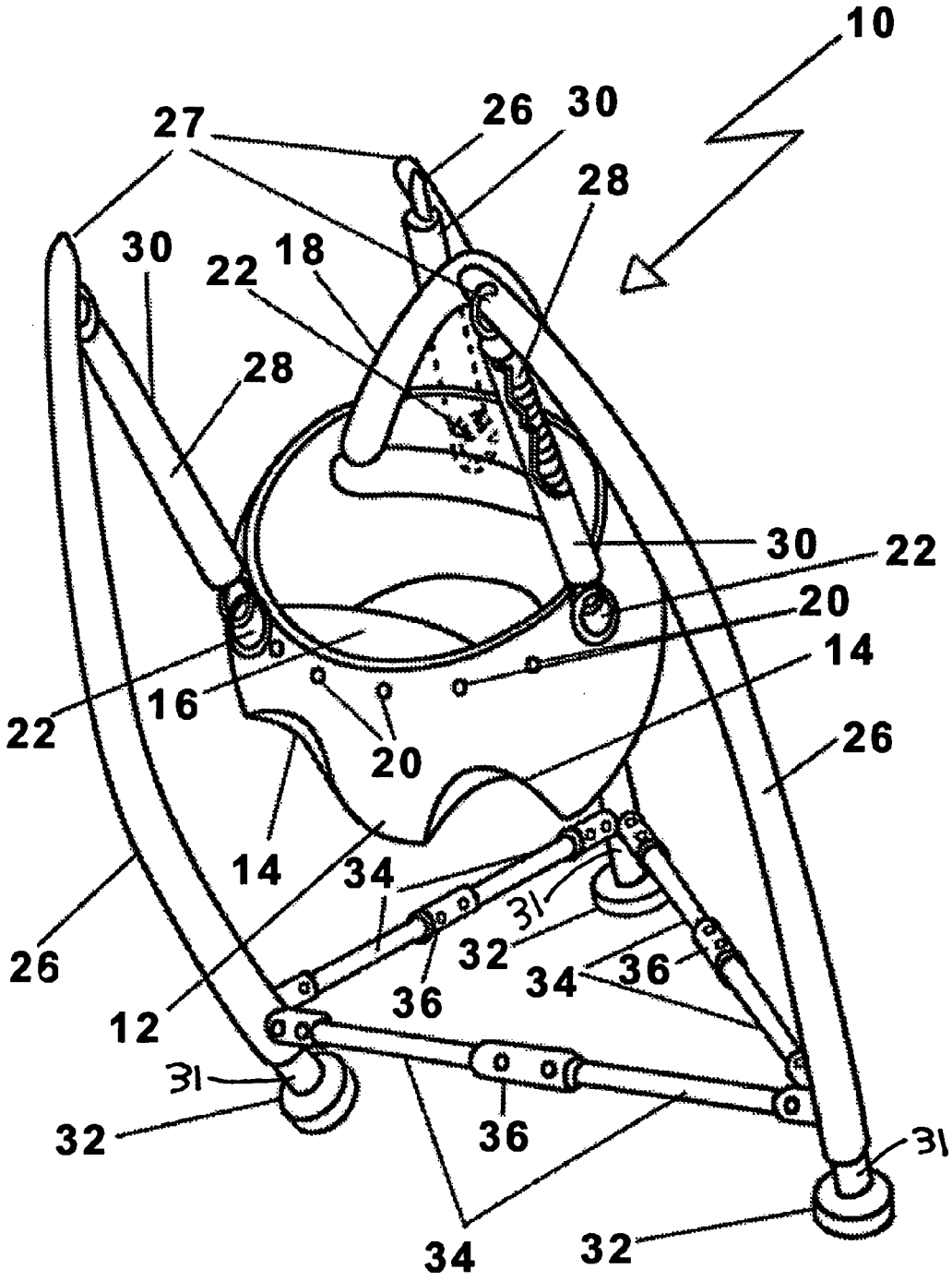
FIG. 1 is a perspective view of a baby bouncer that is in accord with the principles of the present invention.

The presently disclosed subject matter will be described more fully hereinafter with reference to the accompanying drawings, in which some, but not all embodiments are shown. Indeed, this invention may be embodied in many different forms and should not be construed as being limited to the specific embodiment set forth in FIGS. 1 through 4. In the drawings like numbers refer to like elements throughout.

Figure 2:
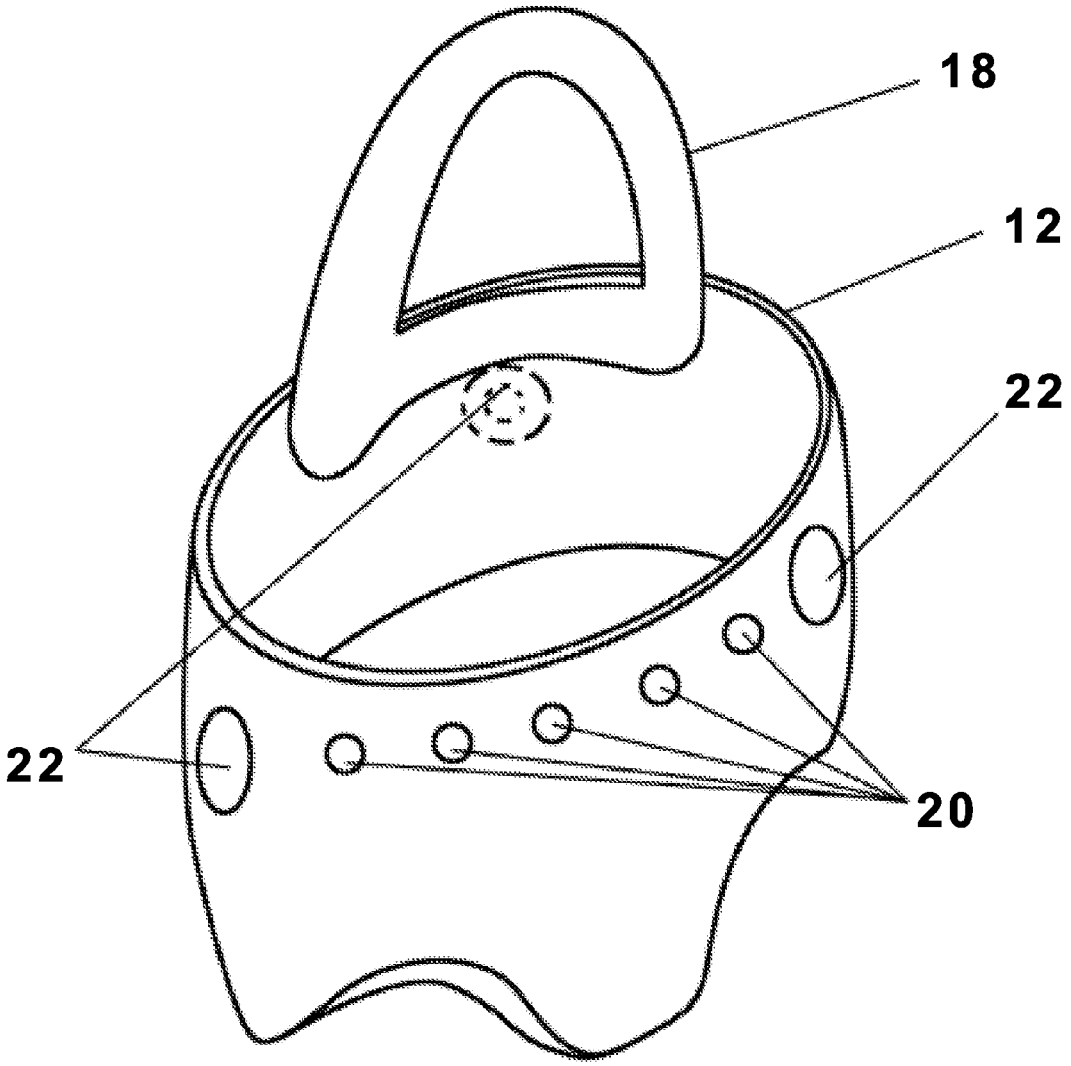
FIG. 2 illustrates a seat for use in the baby bouncer illustrated in FIG. 1.
Figure 3:
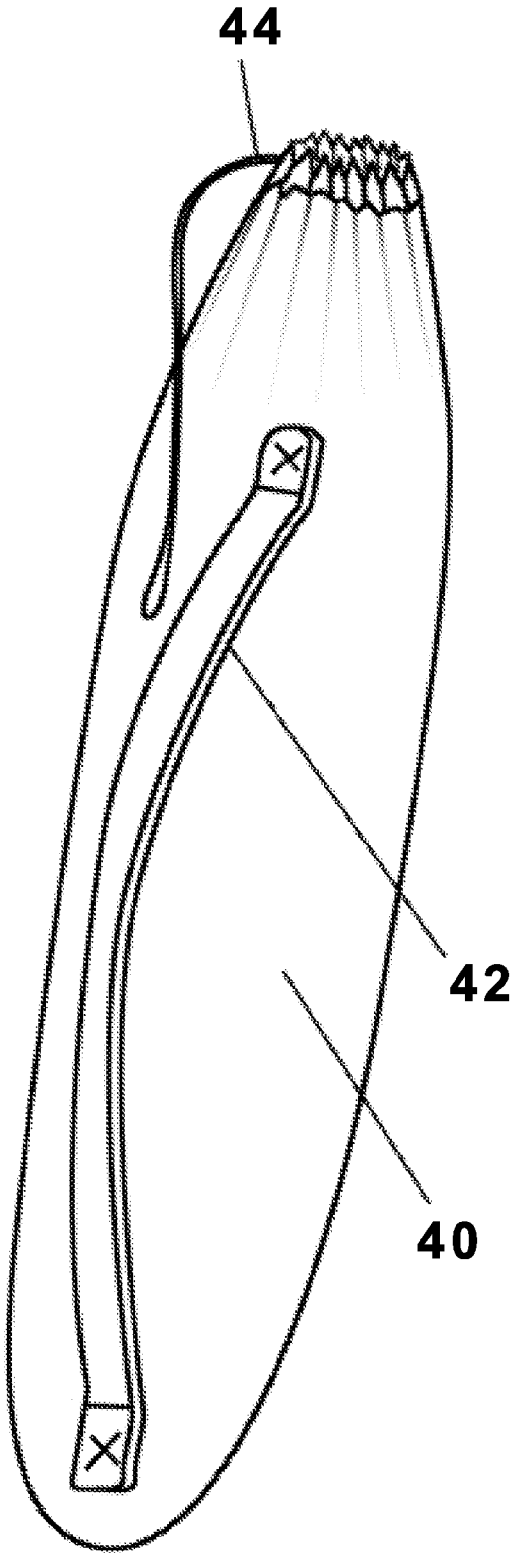
FIG. 3 illustrates the baby bouncer of FIG. 1 folded for travel and/or storage.

Referring now to FIGS. 1 through 4, the principles of the present invention provide for a relatively lightweight, foldable and collapsible baby bouncer 10 that can be selectively expanded into an operating shape or collapsed into an elongated shape (see FIG. 1 for a view of the baby bouncer 10 expanded into am operating state and FIG. 3 for a view of the baby bouncer 10 in a collapsed state that is useful for portability and storage. Referring now specifically to FIGS. 1 and 2, the baby bouncer 10 includes a seat 12 for retaining an infant within the baby bouncer 10. The seat 12 includes two leg holes 14 in a seat pocket 16. For infant protection the seat 12 also includes a high seat back 18 that extends up from the seat pocket 16. The back 18 helps protect in infant within the baby bouncer from whiplash and other neck injuries.

Still referring to FIG. 1, the seat 12 also includes a plurality of accessory holes 20 for assisting attachment of additional features such as rattles, bells, toy bars, and visual stimulators such as lights and mirrors to soothe and/or stimulate the baby. The seat 10 further includes a plurality of seat attachments 22 (shown generically as rings) that assist attaching the seat 12 to the remainder of the baby bouncer 10.

The seat 12 is beneficially removable from the remainder of the baby bouncer 10 via the seat attachments 22. In practice, the seat 12 is preferably mostly comprised of a soft, flexible, and washable material (such as cotton) that is suitable for long-term contact with an infant. This makes for easy cleanup, proper sanitation, infant comfort, and, as subsequently described, portability. However, the seat back 18 may be made somewhat more rigid to provide infant protection while also assisting maintaining the general form of the seat 12. Padding on the seat back 18 can be added to further protect an infant.

It is extremely important that the seat 12, the seat attachments 22, and the leg holes 14 are configured so that a seated infant is protected from injury. For example, it should not be possible for the seat 12 to pinch or choke an infant or to allow an infant to fall from the seat. All materials used to make the seat must be safe for use by an infant, and thus a flame retardant material or coating may be used. The seat 12 can be color coded in accord with infant sex (i.e. pink for girls, blue for boys) or other attribute (i.e., national colors red, white, and blue), or it can be printed with a design.

Referring now to FIG. 1, the seat 12 is retained by three support legs 26 that form a tripod. The top end 27 of each support leg 26 retains a spring 28 that connects to an associated seat attachment 22. The spring 28 which provides a bias support for the seat 12. For both aesthetics and safety reasons each spring 28 is beneficially enclosed within a fabric cover 30.

Still referring to FIG. 1, at the bottom end 31 of each support leg 26 is a foot 32 which beneficially forms a suction cup to firmly retain the baby bouncer 10 on a hard flat surface. The combination of the tripod arrangement of the support legs 26, each having a foot 32 provides stability for the baby bouncer 10. Also beneficially each foot is durable, provides a sufficiently large contract area to safely stabilize the baby bouncer 10 on other than hard flat surfaces and to reduce or eliminate sliding and tipping.

Each support leg 26 is comprised of a sturdy, yet flexible material that can withstand the stresses of holding an active infant. Steel, aluminum, fiberglass, or various engineering plastics (such as glass reinforced Nylon) are suitable materials. It cannot be too highly stressed that the support legs 26, springs 28, seat attachments 22, and fabric cover 30 are configured to protect seated infants from harm.

Still referring to FIG. 1, when deployed the tripod form of the support legs 26 is retained by structural arms 34 that connect pairs of support legs 26. The structural arms 34, in combination with the configuration of the support legs 26, springs 28, and seat attachments 22 form a structurally sound support for the baby bouncer 10.

A feature of the baby bouncer 10 is that it is easily collapsible and foldable. This is achieved by making the structural arms 34 themselves collapsible. Collapsible structural arms 34 can be implemented in numerous ways, such as by using telescoping arms with locking arm assemblies, ratcheting mechanisms, spring loaded snaps that fit into holes or detents in a rail, and a wide range of other mechanisms. However, probably the simplest method is illustrated in FIG. 4.

Figure 4:
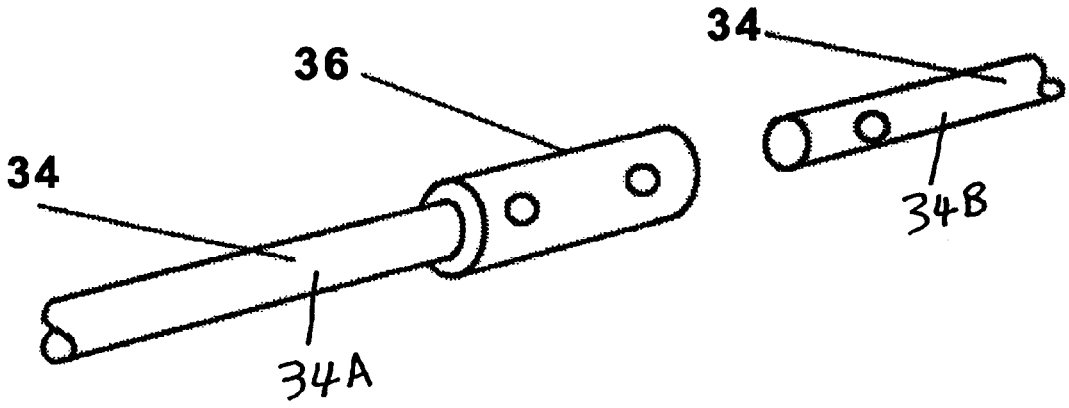
FIG. 4 illustrates a section of a structural arm used in the baby bouncer illustrated in FIG. 1.

Referring now to FIG. 4, a beneficially way to form a collapsible structural arm 34 is to form each structural arm 34 from two parts, shown as arm segments 34A and 34B in FIG. 4, which readily connect together. In FIG. 4 arm segment 34A includes a coupling 36 at one end. The coupling 36 is beneficially configured such that an end of structural arm 34B fits snugly and securely into the coupling 36. This type of construction is often done in tents and other structures that break down into component parts. Then, to assemble a structural arm 34 the two structural arm segments 34A and 34B are fit together.

As shown in FIG. 3, the baby bouncer 10 is collapsible into an elongated form to assist portability. To achieve this, the structural arms 34 are collapsed, which allows the support legs 26 to move. The structural arms 34 and support legs 26 are then aligned in a parallel fashion, the seat 12 is compressed, and the baby bouncer 10 is fit into a sleeve 40 having a handle 42. The sleeve 40 and handle 42 are preferably comprised of a waterproof fabric such as Nylon. The handle 42 is preferably dimensioned to fit over a shoulder for easy carrying, while the sleeve 40 beneficially includes a drawstring 44 to close the sleeve 40.

While the foregoing describes a baby bouncer that is in accord with the principles of the present invention, it is to be understood that the figures and description are exemplary only. For example, it may be desirable to include any number of additional features such as rattles, bells, toy bars, and visual stimulators. Obviously many modifications and variations are possible in light of the above teaching, and thus others who are skilled in the applicable arts will recognize numerous modifications and adaptations that remain within the principles of the present invention. Therefore, the present invention is to be limited only by the appended claims.

What is claimed:

1. A baby bouncer collapsible between a nonexpanded state and an expanded state, comprising:

a seat having a seat pocket for retaining an infant, said seat pocket having two leg holes and a first seat attachment, a second seat attachment, and a third seat attachment, wherein said seat is a soft, flexible, and washable material;

a first spring attached at one end to said first seat attachment of said seat, a second spring attached at one end to said second seat attachment of said seat, and a third spring attached at one end to said third seat attachment of said seat;

an elongated first support leg having a top end attached to another end of said first spring;

an elongated second support leg having a top end attached to another end of said second spring;

an elongated third support leg having a top end attached to another end of said third spring;

wherein said first support leg, said second support leg, and said third support leg form a tripod arrangement in the expanded state of the baby bouncer;

a collapsible first structural arm connected at one end to said first elongated support leg and at another end to said second elongated support leg, a collapsible second structural arm connected at one end to said second elongated support leg and at another end to said third elongated support leg;

a collapsible third structural arm connected at one end to said first elongated support leg and at another end to said third elongated support leg;

a first bottom foot attached to the bottom of said first support leg and below said first structural arm, said first bottom foot having a first suction cup;

a second bottom foot attached to the bottom of said second support leg and below said second structural arm, said second bottom foot having a second suction cup; and a third bottom foot attached to the bottom end of said third support leg and below said third structural arm, said third bottom foot having a third suction cup;

wherein when said first structural arm, said second structural arm, and said third structural arm are in their non-collapsed state they retain said baby bouncer in the expanded state; and wherein when said first structural arm, said second structural arm, and said third structural arm are in their collapsed state said baby bouncer is in the nonexpanded state; and wherein said first support leg, said second support leg, and said third support leg are aligned in the tripod arrangement when the baby bouncer is in the expanded state and wherein the first support leg, the second support leg, and the third support leg are aligned in a parallel fashion and the seat is compressed when the baby bouncer is in the nonexpanded state, so that the baby bouncer can be selectively expanded into the expanded state and can be selectively collapsed into the nonexpanded state, wherein said baby bouncer has an elongated form in the nonexpanded state to assist in a portability of the baby bouncer.

2. A baby bouncer according to claim 1, wherein said first structural arm is comprised of a first arm segment having a coupling at one end and a second arm segment configured to securely mate with said coupling, and wherein said second arm segment can be selectively removed from said coupling.

3. A baby bouncer according to claim 1, wherein said first structural arm is straight.

4. A baby bouncer according to claim 1, wherein said seat includes a rigid high seat back that extends up from the seat pocket.

5. A baby bouncer according to claim 1, wherein said seat includes a plurality of accessory holes.

6. A baby bouncer according to claim 1, wherein said first, said second, and said third springs bias said seat to a neutral position when said baby bouncer is expanded.

7. A baby bouncer according to claim 1, wherein said first, said second and said third springs are each enclosed in fabric.

8. A baby bouncer according to claim 1, further including a sleeve having a handle, wherein said sleeve retains said baby bouncer when said baby bouncer is formed into said elongated form.

9. A baby bouncer according to claim 8, wherein said sleeve has a drawstring.

* * * * *